US006076333A

United States Patent [19]

Stoker

[11] Patent Number: 6,076,333

[45] Date of Patent: Jun. 20, 2000

[54] MANUFACTURE AND DISTRIBUTION OF INTRAVENOUS SOLUTIONS

[75] Inventor: Pieter Wilhelm Stoker, Vanderbijlpark, South Africa

[73] Assignee: Inmed Investment Holding Company (Proprietary) Limited, Vereeniging, South Africa

[21] Appl. No.: 08/952,196

[22] PCT Filed: May 24, 1996

[86] PCT No.: PCT/US96/07612

§ 371 Date: Nov. 10, 1997

§ 102(e) Date: Nov. 10, 1997

[87] PCT Pub. No.: WO96/37409

PCT Pub. Date: Nov. 28, 1996

[30] Foreign Application Priority Data

May 25, 1995 [ZA] South Africa ..... 95/4291

[51] Int. Cl.[7] ..... B65B 55/02

[52] U.S. Cl. ..... 53/425; 53/445; 53/449; 53/474

[58] Field of Search ..... 53/154, 155, 167, 53/171, 237, 238, 240, 425, 426, 428, 445, 449, 474

[56] References Cited

U.S. PATENT DOCUMENTS

| | | | |
|---|---|---|---|
| 2,659,187 | 11/1953 | Barnes . | |
| 3,893,280 | 7/1975 | King . | |
| 4,467,588 | 8/1984 | Carveth . | |
| 5,014,494 | 5/1991 | George . | |
| 5,157,900 | 10/1992 | Kupersmit . | |
| 5,373,684 | 12/1994 | Vacca | 53/425 |
| 5,406,770 | 4/1995 | Fikacek . | |
| 5,511,594 | 4/1996 | Brennan et al. | 53/425 X |
| 5,682,728 | 11/1997 | DeBusk et al. | 53/445 |
| 5,715,646 | 2/1998 | Smekens | 53/167 X |

*Primary Examiner*—Daniel B. Moon
*Attorney, Agent, or Firm*—Ladas & Parry

[57] ABSTRACT

Intravenous solutions are manufactured and distributed in batches by gathering raw materials and components for manufacturing containers for intravenous solutions, and active ingredient but excluding solvent. In a central manufacturing plant, critical steps are performed such as dispensing predetermined amounts of the active ingredient into holders. The products of the central manufacturing plant are packed into shipping containers which are distributed to respective decentralized manufacturing plants where the contents are unpacked, manufacture of containers is completed, solvent is obtained, intravenous solution is mixed, and the containers are filled, hermetically sealed and sterilized in an autoclave.

14 Claims, 1 Drawing Sheet

MANUFACTURE AND DISTRIBUTION OF INTRAVENOUS SOLUTIONS

Figure 1:
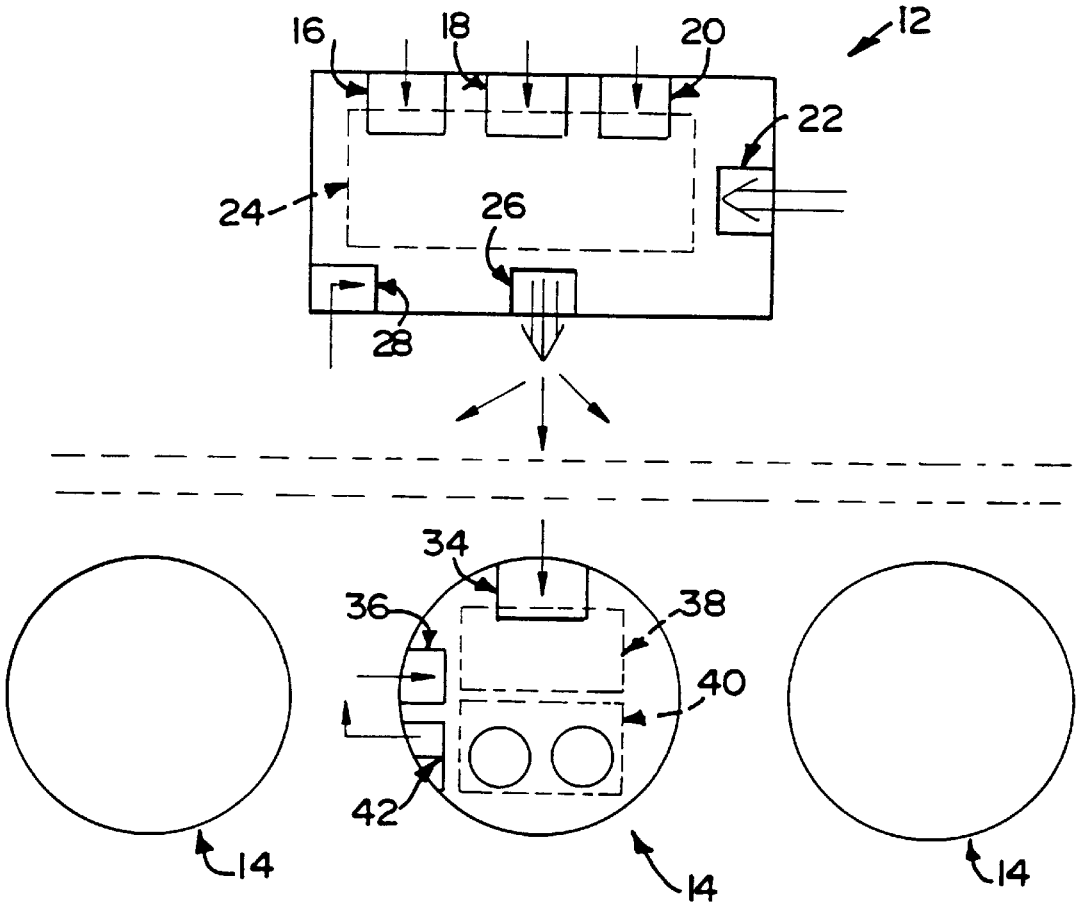

THIS INVENTION relates to the manufacture and distribution of intravenous solutions. It relates more specifically to a method of manufacturing intravenous solutions, to a method of distributing intravenous solutions, to a manufacturing plant for use in the manufacture of intravenous solutions, and to a shipping container suitable for use in the manufacture and distribution of intravenous solutions.

Conventionally, in one version, intravenous solutions are provided to an end user such as a hospital, clinic or the like as an intravenous solution container in the form of a hermetically sealed container such as a flexible bag of synthetic plastics material containing the solution. The synthetic plastics bag is wrapped or contained in an overwrapper or overpouch. Such bags are filled with intravenous solution via a port under clean, preferably sterile, conditions, hermetically sealed, wrapped in an overpouch which is hermetically sealed and evacuated and sterilised in the hermetically sealed condition in an autoclave. They are thereafter shipped to intermediate or end destinations.

In another version, the intravenous solutions are charged into containers, such as semi-rigid pouches or sachets of polypropylene material, hermetically sealed, sterilized and then distributed.

In accordance with a first aspect of this invention, there is provided a method of manufacturing a batch of intravenous solution, the method including in a central manufacturing plant, obtaining premanufactured components and materials including active ingredient, containing means for intravenous solution and a shipping container and excluding solvent, performing manufacturing steps on the containing means in the manufacture of individual ported containers for intravenous solution, dispensing the active ingredient in predetermined dosages into holders, and packing the containing means and the holders in the shipping container;

shipping the shipping container to a decentralised manufacturing plant;

in the decentralised manufacturing plant, unpacking the shipping container, obtaining solvent, preparing a predetermined solution from the solvent and the pre-dispensed active ingredient, completing manufacture of the containing means into individual ported containers, filling the respective individual ported containers with the prepared solution, sealing the filled containers and sterilising the sealed containers in an autoclave.

The method may include, in the central manufacturing plant, verifying the quality of the components and materials obtained in the central manufacturing plant. The method may further include, in the decentralised manufacturing plant, performing quality assurance steps as required or as appropriate for the product being manufactured.

When the individual ported containers are in the form of flexible bags of synthetic plastics material, the method may include overwrapping the flexible bags in overpouches, and hermetically sealing and evacuating the overpouches prior to sterilizing.

Manufacturing steps performed on the containing means in the central manufacturing plant may include processing of premanufactured sheet material into lay flats, laminates, bags or the like. The method may include mounting ports in the bags. Generally, in a preferred method, the bags are manufactured and printed in the central manufacturing plant ready to be filled. The manufacturing steps in manufacture of overpouches may merely include providing a double layered web in roll form (also known as "lay flat") which has to be sealed bottom and top to contain the bag after it has been filled with the intravenous solution. Thus, the method may further include marking at least one of the bags and the overpouch material with identification markings. The method may further advantageously include preparing documentation including records and certification documents in association with manufacturing in the central manufacturing plant and associating such documentation with the respective batch of intravenous solution. Such documentation may, in some instances, be partially completed and is then intended to be completed in association with final manufacture in the decentralised manufacturing plants. The documentation may be linked to, for example by markings, such as later to be identifiable with, the shipping container. The documentation may be transmitted to the respective decentralized manufacturing plant by data link. Instead, the documentation may physically accompany the shipping container.

Broadly, manufacture in the central manufacturing plant may include at least some of quality control, production control and like functions normally associated with initial stages of manufacture in a conventional unitary intravenous solution plant.

Packaging of the containing means and holders of active ingredient may be into a cassette or casing by mechanical or robotic means without human touch, and the method may include sealing the cassette or casing hermetically prior to incorporation thereof into the shipping container. Preferably, such packaging may be effected under clean room conditions.

Manufacturing in the decentralised manufacturing plant may include arranging the hermetically sealed cassette or casing in a predetermined position and orientation relative to mechanical or robotic apparatus and mechanically or robotically unpacking the contents and processing the contents further until sterilisation in the autoclave without human touch, and generally under cleanroom conditions.

Broadly, manufacturing steps in the decentralised manufacturing plants may correspond generally to manufacturing steps during final stages of manufacture in a unitary plant for manufacture of intravenous solutions.

In accordance with a second aspect of this invention, there is provided a method of distributing intravenous solution including in a central manufacturing plant, performing initial manufacturing operations including obtaining premanufactured materials and components including active ingredient, containing means for intravenous solution and shipping containers and excluding solvent, performing initial manufacturing steps on said premanufactured materials and components, dispensing active ingredient into holders and packaging the products of the central manufacturing plant in batches into the respective shipping containers;

shipping the respective shipping containers to respective decentralised manufacturing plants; and in each of the respective decentralised manufacturing plants, unpacking the respective shipping containers, providing solvent, preparing a predetermined solution from the solvent and the predispensed active ingredient, filling the containers with the prepared solution and sterilising the filled containers with intravenous solution in an autoclave to provide a batch of intravenous solution.

Accordingly, in respect of a third aspect, the invention provides a central manufacturing plant for performing initial steps in the manufacture of a batch of intravenous solution, the central manufacturing plant including a receiving station for premanufactured materials and components for containers for intravenous solution;

a receiving station for active ingredient;

a receiving station for holders for active ingredient;

dispensing apparatus for dispensing active ingredient in predetermined dosages into said holders;

container manufacturing apparatus for performing initial steps in the manufacture of containers from said premanufactured materials and components; and packaging apparatus for packaging the holders with active ingredient and products of the container manufacturing apparatus into a shipping container.

The central manufacturing plant may further include a receiving station for premanufactured materials and components for overpouches if the containers are to be in the form of flexible bags intended to be over-wrapped.

The invention extends, in respect of a fourth aspect, to a shipping container including a plurality of compartments accommodating, in batch form, respectively hermetically sealed casings or cassettes containing respectively containing means for intravenous solution, and active ingredient for intravenous solution in predispensed amounts in holders.

The shipping container may, advantageously, further include an hermetically sealed casing containing ports for use in automatically or robotically filling containers for intravenous solution.

The cassettes or casings may conveniently comprise datum surfaces or formations for arranging the cassettes or casings in predetermined positions and orientations relative to mechanical handling or robotic equipment.

The invention extends further, in respect of a fifth aspect, to a decentralised manufacturing plant for receiving a shipping container in accordance with the fourth aspect, and for completion of manufacture of containers containing intravenous solution in a batch, the decentralised manufacturing plant including a receiving station for receiving the shipping container;

mechanical or robotic handling equipment for unpacking and further handling of the containing means and the holders of active ingredient contained in the sealed casings or cassettes of the shipping container;

a receiving station for receiving water to form a solvent;

a processing station to process the water into a solvent of an appropriate quality;

a mixing means for mixing active ingredient into solvent to form a predetermined solution;

filling means for filling containers with solution; and an autoclave for sterilising the containers filled with intravenous solution.

When the containing means is in the form of partially manufactured containers, the decentralised manufacturing plant may include container manufacturing means for completing manufacturing of the containers.

If the containers are in the form of flexible synthetic plastics bags, the decentralised manufacturing plant may have overwrapper manufacturing means and evacuating means respectively for overwrapping the bags when filled in overwrappers or overpouches, and hermetically sealing and evacuating the overwrappers or overpouches around the filled bags.

The invention is now described by way of example with reference to the accompanying schematic drawings. In the drawings FIG. 1 shows, schematically, a central manufacturing plant and a plurality of decentralised manufacturing plants in accordance with the invention; and FIG. 2 shows, schematically, in three dimensional view, a shipping container suitable for shipping intermediate products in the manufacture of intravenous solutions from the central manufacturing plant to the decentralised manufacturing plants of FIG. 1.

Figure 2:
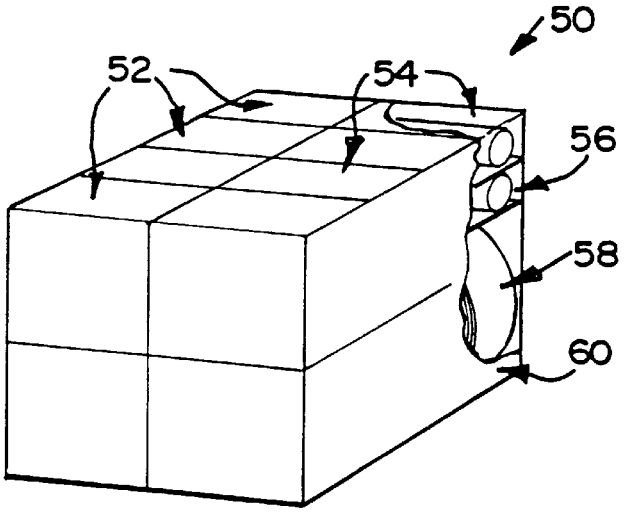

With reference to FIG. 1 of the drawings, a central manufacturing plant in accordance with the invention is generally indicated by reference numeral 12. The central manufacturing plant receives premanufactured material and components as well as active ingredient and performs manufacturing steps including packaging steps to produce and package into a shipping container intermediate products in the manufacture of intravenous solutions in such quantities as to manufacture a batch of intravenous solution. The shipping containers are distributed to a plurality of decentralised manufacturing plants generally indicated by reference numerals 14 in which decentralised manufacturing plants the intermediate products are unpacked, in which solvent is received and processed and in which manufacture of intravenous solutions contained in sterilised containers is completed.

For purposes of illustrating the invention by way of example, that version of the invention in which the intravenous solution is to be contained in flexible synthetic plastics bags which are to be overwrapped in overpouches, will be used.

The central manufacturing plant includes a plurality of receiving stations indicated respectively by reference numerals 16, 18 and 20. The receiving stations are, for example, for bag means, active ingredient and other components or materials required. The bag means will include premanufactured components and materials such as granules and layflat, sheet material of synthetic plastics material and the like which may ultimately be manufactured into ported bags and overpouches.

The receiving stations are interfaced with mechanical handling and manufacturing apparatus 24, such as robotic apparatus for handling the material and components and for performing the initial manufacturing steps without human touch. This allows the manufacturing steps or at least some of the manufacturing steps to be performed under clean, even sterile, conditions.

It is to be appreciated that manufacturing steps in the central manufacturing plant 12 generally correspond to initial manufacturing steps in a conventional, unitary manufacturing plant for intravenous solutions. Thus, there is also provided a receiving station schematically indicated by reference numeral 22 for human or intellectual input such as quality testing, assembly, preparing records and other documents, stock keeping, production and maintenance support in the form of telephone links, modem links, facsimile links, production logging and performance monitoring, regulatory inspections as may be required by the relevant authorities where the decentralised manufacturing plants are situated, quality control functions, and the like. Many of these functions may be effected by means of or with the aid of a computer. The records and the like may be kept on magnetic media.

The central manufacturing plant 12 further has a receiving station 28 for receiving feedback from decentralised manufacturing plants, for example to receive samples to effect finished product sterility testing, finished product particle counts, and the like.

The manufacturing steps of the central manufacturing plant produce intermediate products in the manufacture of intravenous solution contained in sterilised form in bags. Such intermediate products typically include bags for containing the solution which bags are ported and in finalised form and include even printing or other markings to identify the ultimate product. The intermediate products may further include double layered sheet material in webbing or sheet form in rolls or "layflat" for the manufacture of overpouches. The intermediate product will further include active ingredient in predetermined dispensed quantities contained in sterile holders. The finished product may further include other components or materials required to complete manufacture such as injection ports for use in filling the bags with intravenous solution in the decentralised manufacturing plants. Such ports will be contained in sterile form in hermetically sealed cassettes or holders. If desired preprinted containers for the finalised intravenous solution containing bags may be provided in collapsed form.

The central manufacturing plant performs also a packaging operation during which the intermediate products, for example bags and ports prepacked in hermetically sealed cassettes or the like, are packed in shipping containers which will be described in more detail with reference to FIG. 2. The shipping containers are shipped from the central manufacturing plant 12 from a despatch station 26.

As described above, documentation (which may be on magnetic media) will be prepared in the central manufacturing plant. Such documentation may also be packed or attached to the shipping container physically to accompany the intermediate products to the decentralised manufacturing plants. Instead, the documentation may be coded or otherwise marked in conjunction with the shipping containers to enable the documentation to be despatched by other means, such as by data link, to the decentralised manufacturing plants and to be remarried to the respective shipping containers or the intermediate products in the decentralised manufacturing plants.

It is envisaged that the central manufacturing plant will perform those functions required for the manufacture of intravenous solutions which are critical to finished product quality and which are cost effective to centralise.

The shipping containers are then shipped to various decentralised manufacturing plants as required.

A typical shipping container is shown schematically in FIG. 2. It comprises a plurality of compartments, for example a plurality of compartments indicated by reference numeral 52 to accommodate cassettes or casings containing sterile preprinted bags, in hermetically sealed form, ready for filling. One or more compartments 54 are provided for containers containing predispensed active material in holders. A compartment 56 is provided to accommodate an hermetically sealed casing or cassette containing sterile injection ports. A compartment 58 accommodates sheet material in roll form for overpouches or overwrappers. A compartment 60, which may for example be at a bottom of the shipping container 50, contains printed containers such as boxes in collapsed form to accommodate the bags when manufacture has been completed.

It is envisaged that the shipping container will contain intermediate products on a "stoichiometric" principle i.e. there will be sufficient, but only sufficient, intermediate products to manufacture a batch of intravenous solution such that no intermediate product is left after manufacture. This principle will effectively eliminate wastage and will also serve as an additional check that manufacture has been effected as planned. It will further promote good manufacturing practices which require batch control principles to be implemented.

Again with reference to FIG. 1, one decentralised manufacturing plant 14 is described in more detail. It has a receiving station 34 for receiving shipping containers. The receiving station 34 will interface with a first unpacking zone where the container may be stripped of its contents down to the level of sealed containers. The sealed containers are then offered to mechanical or robotic handling and manufacturing equipment adapted for receiving hermetically sealed casings or cassettes such that those can be unpacked and the contents further processed without human touch, in clean room conditions.

The decentralised manufacturing plant 14 further includes a receiving and processing station 36 for solvent. Instead, if desired, raw material for solvent such as untreated or partially treated water may be received and further processed to provide solvent. However, generally, water of a quality fit for drinking will be readily available and will be supplied to be further processed to produce water of a "water for injection" quality.

The decentralised manufacturing plant 14 introduces the respective dosages of active ingredient and solvent for mixing into mixing tanks, from which the solution is introduced into the respective bags. The decentralised manufacturing plant seals the bags, overwraps the bags, hermetically seals and evacuates the overpouches and then sterilises the intravenous solution as contained in the overwrapped bags in an autoclave 40. The finished product in the form of an overwrapped, sterilised bag containing sterilised intravenous solution is then handled and further distributed in conventional fashion.

It is to be appreciated that feedback from the decentralised manufacturing plant 14 takes place e.g. from a sampling station 42 which inputs into the feedback station 28 of the central manufacturing plant.

It is a first advantage that intravenous solutions can be manufactured in respect of predetermined critical manufacturing steps in a central manufacturing plant, that intermediate product can be distributed from the central manufacturing plant without containing solvent which saves the predominant portion of the weight and mass of the finished product. Manufacture is then completed in a decentralised manufacturing plant where solvent is added. It is envisaged that the volume and mass of intermediate product shipped will be substantially less than a corresponding mass and volume of final product which is conventionally shipped. Furthermore, the intermediate product shipped is "dry" and thus less fragile and less prone to damage in transit. It is thus envisaged that conventional transport can be used for transport of the intermediate products. This aspect is further enhanced by the provision of dedicated shipping containers designed to impart high integrity to transport of the intermediate products without and over-reliance on the mode of transport. If desired, tamper evident features may be incorporated into the shipping containers.

It is further envisaged that intermediate products can effectively and relatively cheaply be stored at strategic locations until required, much more effectively and with a longer shelf life than completed product. This should enhance the availability of finished product as an intermediate product can be stored close to a final destination and the final manufacturing steps can be effected when required close to said final destination. It is to be appreciated that, if desired, the shipping containers can be stored in unpacked condition. Instead, the shipping containers can be unpacked to a level that the hermetically sealed cassettes or casings are stored in sealed condition.

It is further an advantage that quality, e.g. sterility and concentration, of the final product is not compromised by the two stage manufacturing procedure.

I claim:

1. A method of manufacturing a batch of intravenous solution, the method including in a central manufacturing plant, obtaining premanufactured components and materials including active ingredient, containing means for intravenous solution and a shipping container and excluding solvent, performing manufacturing steps on the containing means in the manufacture of individual ported containers for intravenous solution, dispensing the active ingredient in predetermined dosages into holders, and packing the containing means and the holders in the shipping container;

shipping the shipping container to a decentralised manufacturing plant;

in the decentralised manufacturing plant, unpacking the shipping container, obtaining solvent, preparing a predetermined solution from the solvent and the predispensed active ingredient, completing manufacture of the containing means into individual ported containers, filling the respective individual ported containers with the prepared solution, sealing the filled containers and sterilising the sealed containers in an autoclave.

2. A method as claimed in claim 1 including, in the central manufacturing plant, verifying the quality of the components and materials obtained in the central manufacturing plant.

3. A method as claimed in claim 1 including, in the decentralised manufacturing plant, performing quality assurance steps as required or as appropriate for the product being manufactured.

4. A method as claimed in claim 1, including, when the individual ported containers are in the form of flexible bags of synthetic plastics material, overwrapping the flexible bags in overpouches, and hermetically sealing and evacuating the overpouches prior to sterilizing.

5. A method as claimed in claim 4 in which manufacturing steps performed on the containing means in the central manufacturing plant include processing of premanufactured sheet material into lay flats, laminates or bags.

6. A method as claimed in claim 5 including mounting ports in the bags.

7. A method as claimed in claim 5 or claim 6 including marking at least one of the bags and the overpouch material with identification markings.

8. A method as claimed in claim 1 including preparing documentation including records and certification documents in association with manufacturing in the central manufacturing plant and associating such documentation with the respective batch of intravenous solution.

9. A method as claimed in claim 1 in which manufacture in the central manufacturing plant includes at least some of quality control, production control and like functions normally associated with initial stages of manufacture in a conventional unitary intravenous solution plant.

10. A method as claimed in claim 1 in which packaging of the containing means and holders of active ingredient is into a cassette or casing by mechanical or robotic means without human touch, the method including sealing the cassette or casing hermetically prior to incorporation thereof into the shipping container.

11. A method as claimed in claim 10 in which such packaging is effected under clean room conditions.

12. A method as claimed in claim 1 in which manufacturing in the decentralised manufacturing plant includes arranging a hermetically sealed cassette or casing in a predetermined position and orientation relative to mechanical or robotic apparatus and mechanically or robotically unpacking the contents and processing the contents further until sterilisation in the autoclave without human touch, and generally under cleanroom conditions.

13. A method as claimed in claim 1 in which the manufacturing steps in the decentralised manufacturing plants correspond generally to manufacturing steps during final stages of manufacture in a unitary plant for manufacture of intravenous solutions.

14. A method of distributing intravenous solution including in a central manufacturing plant, performing initial manufacturing operations including obtaining premanufactured materials and components including active ingredient, containing means for intravenous solution and shipping containers and excluding solvent, performing initial manufacturing steps on said premanufactured materials and components, dispensing active ingredient into holders and packaging the products of the central manufacturing plant in batches into the respective shipping containers;

shipping the respective shipping containers to respective decentralised manufacturing plants; and in each of the respective decentralised manufacturing plants, unpacking the respective shipping containers, providing solvent, preparing a predetermined solution from the solvent and the predispensed active ingredient, filling the containing means with the prepared solution and sterilising the filled containing means with intravenous solution in an autoclave to provide a batch of intravenous solution.

* * * * *